US010468735B2

(12) United States Patent
Kaehs

(10) Patent No.: US 10,468,735 B2
(45) Date of Patent: Nov. 5, 2019

(54) DUMMY LOAD FOR HIGH POWER AND HIGH BANDWIDTH

(71) Applicant: Rohde & Schwarz GmbH & Co. KG, Munich (DE)

(72) Inventor: Bernhard Kaehs, Hoehenkirchen-Siegertsbrunn (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 41 days.

(21) Appl. No.: 15/835,124

(22) Filed: Dec. 7, 2017

(65) Prior Publication Data

US 2019/0181527 A1 Jun. 13, 2019

(51) Int. Cl.
*H01P 1/26* (2006.01)
*H01P 3/06* (2006.01)

(52) U.S. Cl.
CPC ..... *H01P 1/266* (2013.01); *H01P 3/06* (2013.01)

(58) Field of Classification Search
CPC .... H01P 1/266; H01P 1/26; H01P 1/24; H01P 3/06
USPC ..... 333/22 R
See application file for complete search history.

(56) References Cited

U.S. PATENT DOCUMENTS 3,646,482 A * 2/1972 Ursenbach ..... H01P 1/266 333/22 F
2011/0175690 A1* 7/2011 Antkowiak ..... H01P 1/266 333/22 F

* cited by examiner

*Primary Examiner* — Stephen E. Jones
(74) *Attorney, Agent, or Firm* — Christensen O'Connor Johnson Kindness PLLC

(57) ABSTRACT

A dummy load for high power and high bandwidth, the dummy load comprising a base plate, a resistive termination acting as a resistive load for dissipating radio frequency power at low frequencies, and at least one coaxial cable acting as a cable load for dissipating radio frequency power at high frequencies, the at least one coaxial cable being connected to the resistive termination. At least one of the resistive termination and the at least one coaxial cable is positioned on the base plate. The at least one coaxial cable has a cross section that varies over the length of the coaxial cable.

18 Claims, 3 Drawing Sheets

DUMMY LOAD FOR HIGH POWER AND HIGH BANDWIDTH

TECHNICAL FIELD

Embodiments of the present disclosure relate to a dummy load for high power and high bandwidth.

BACKGROUND

In the state of the art, dummy loads for radio frequency applications (RF applications) are known wherein different types of dummy loads are used for different radio frequency applications. For instance, dummy loads are established by resistive loads which are typically used for frequencies less than 1.5 GHz to 2.0 GHz at powers higher than 1 kW as they only ensure a suitable matching up to these frequencies. Further, these dummy loads, which are established by resistive loads, require ceramic substrates for heat dissipation which, however, may break already at short-term overload. Furthermore, such resistive dummy loads typically have an insufficient shielding attenuation such that the resistive dummy loads cannot be used within an Electromagnetic Compatible Chamber (EMC chamber).

Besides the resistive dummy loads, dummy loads are known which are established by cable loads. For achieving a good matching, the attenuation of the cable load is used which increases with frequency. The electromagnetic signal, namely the electromagnetic wave, fed into the cable is attenuated by the cable attenuation value wherein the reflected portion is attenuated twice by the cable attenuation value. In general, the cable attenuation increases by the square root of the frequency such that the cable attenuation becomes very high for high frequencies wherein the matching is specified by the quality of the connectors and cables used. However, the cable attenuation is very low for low frequencies so that dummy loads established by cable loads are used for frequencies higher than several hundred MHz in order to ensure a good matching.

Thus, the dummy loads known in the state of the art are not suitable for amplifiers which require a good matching for high frequencies, for instance up to 6 GHz, and sufficient power as the dummy loads known in the state of the art would be damaged due to the occurring overloads.

SUMMARY

Accordingly, there is a need for a dummy load that can be used for high power and high bandwidth applications without the risk of being damaged.

Embodiments of the present disclosure provide a dummy load for high power and high bandwidth, the dummy load comprising: a base plate, a resistive termination acting as a resistive load for dissipating radio frequency power at low frequencies, and at least one coaxial cable acting as a cable load for dissipating radio frequency power at high frequencies, wherein the at least one coaxial cable being connected to the resistive termination, wherein at least one of the resistive termination and the coaxial cable being positioned on the base plate and wherein the at least one coaxial cable having a cross section that varies over the length of the at least one coaxial cable.

Further, embodiments of the present disclosure provide a dummy load for high power and high bandwidth, the dummy load comprising: a base plate, a resistive termination acting as a resistive load for dissipating radio frequency power at low frequencies, and at least one coaxial cable acting as a cable load for dissipating radio frequency power at high frequencies, wherein the at least one coaxial cable being connected to the resistive termination, wherein the at least one coaxial cable being arranged in a helical manner within a groove formed in the base plate, and wherein at least one cover being connected to the base plate such that the resistive termination and the at least one coaxial cable being accommodated between the cover and the base plate.

The dummy load according to the present disclosure compensates the matching properties of the resistive load which gets worse with increasing frequency by the frequency dependent attenuation of the coaxial cable which affects the matching. In other words, the matching of the resistive termination which becomes worse with increasing frequency is compensated by the frequency depending attenuation of the coaxial cable that is connected to the resistive termination such that a good matching of the whole dummy load is provided for a high bandwidth and at high powers.

For low frequencies of the radio frequency signals, the power of the radio frequency signals inputted to the dummy load is substantially completely forwarded to the resistive termination due to the small cable attenuation of the coaxial cable. Thus, the input matching of the dummy load is mainly specified by the resistive termination.

For high frequencies, the cable attenuation of the coaxial cable increases such that the power reaching the resistive termination is attenuated effectively. Thus, the matching of the dummy load is mainly specified by the cable attenuation of the coaxial cable.

For middle frequencies, the input matching of the dummy load is improved due to the (dual) cable attenuation of the coaxial cable.

In general, the combination of the resistive termination and the coaxial cable connected with each other ensures that a bandwidth up to 10 GHz can be processed in an appropriate manner while providing a good matching of the dummy load. In addition, the dummy load has a high robustness against short-term overloads since the resistive termination is already relieved for signals with low frequencies due to the cable attenuation increasing with frequency.

In addition, a dummy load is provided that has broadband characteristics with a high return loss over the whole frequency band for high powers at a small form factor due to the combination of the coaxial cable and the resistive termination combined with each other.

Moreover, the dummy load is usable for very high peak powers due to the combination of the coaxial cable and the resistive termination as the radio frequency powers are attenuated appropriately.

The dummy load further provides a good radio frequency shielding over the whole frequency range. For low frequencies, the shielding is provided by the cover and the base plate, whereas the coaxial cable provides the shielding for high frequencies. Accordingly, the dummy load can be used for applications in Electromagnetic Compatible Chambers (EMC Chambers).

Generally, the dummy load can be cooled by water, air, forced air, free convection or any other suitable material used for heat exchange.

In addition, the varying cross section of the coaxial cable ensures that the power can be increased for high frequency signals.

Moreover, the example of the arrangement of the coaxial cable in a helical manner within a groove formed in the base plate ensures that a good matching of the dummy load is provided wherein the space utilization of the dummy load is optimized.

According to an aspect, the cross section varies in a stepwise manner. The coaxial cable may be established by at least two cable sections having a different cross section such that the cross section of the coaxial cable varies over its length. The two coaxial cable sections may be connected together via a transition member.

Generally, the at least two cable sections may be established by at least two different coaxial cables being connected with each other via the transition member.

Another aspect provides that the at least one coaxial cable is arranged in a helical manner, the cross section decreasing inwardly over the length of the at least one coaxial cable. Accordingly, the coaxial cable is arranged such that the section with the higher cross section is located in the radially outer area, which circumferences the coaxial cable section with the lower cross section that is located in the central portion with regard to the base plate. For high frequencies, the cable attenuation of the coaxial cable increases such that the power is converted in the outer windings of the helically arranged coaxial cable. In order to avoid an overload, the outer windings of the coaxial cable are established by a coaxial cable section having a higher cross section with lower attenuation compared to a coaxial cable section with lower cross section. Accordingly, the power loss of the overall coaxial cable is distributed substantially homogenously over the whole coaxial cable such that high input powers can be used.

The length of the coaxial cable section with a higher cross section may be set such that the attenuation is high enough in order to ensure that the coaxial cable section with the lower cross section is not overloaded by the high frequency applications intended to be used. In other words, the at least two coaxial cable sections are set in a correlated manner.

The overall length of the coaxial cable may be set such that the matching of the resistive terminal, which becomes worse with increasing frequency, is compensated by the attenuation of the coaxial cable in order to ensure the required matching, for instance a return loss of 30 dB.

According to another aspect, at least one of a cut out for the resistive termination and a groove for the at least one coaxial cable is provided in the base plate. Thus, the resistive termination and the coaxial cable may be at least partly integrated in the base plate due to the cut out and the groove, respectively. This also ensures that the heat occurring in the resistive termination and/or the load can be dissipated easily.

For instance, the cut out and/or the groove are milled in the base plate appropriately. Thus, the cut out and the groove are provided in a cost-efficient manner.

In some embodiments, the cut out for the resistive termination is located in a middle area of the base plate. Hence, the resistive termination acting as the resistive load for the low frequencies is located in the center area or in the middle area of the base plate.

Moreover, the groove for the coaxial cable may be helically arranged on at least one side of the base plate. Thus, a compact arrangement for the coaxial cable is ensured wherein the surface of the base plate is used in an optimized manner.

According to another aspect, the groove runs around the resistive termination at least once. Therefore, a compact design of the dummy load with regard to the resistive termination and the coaxial cable is ensured. In some embodiments, the radii of the at least one coaxial cable located in the groove are as high as possible ensuring good transmission properties when the groove runs around the resistive termination, in particular the cut out.

Another aspect provides that the groove for the at least one coaxial cable is provided on opposite sides of the base plate such that the at least one coaxial cable is arranged on both sides of the base plate. Accordingly, the base plate is used as a carrier for the coaxial cable which might have a length that requires to be located on both sides of the base plate. Very long coaxial cables can be used for transmitting the signals towards the resistive termination.

The base plate may have a through-hole that is used for connecting both sides of the base plate.

In some embodiments, the groove for the at least one coaxial cable has curvatures, the groove being widened in the curvatures such that the groove has an expansion space for the at least one coaxial cable in the curvatures. This ensures that the coaxial cable has enough space which is required due to its thermal expansion. The biggest influence on the coaxial cable is expected to be in the curvature area of the helically arranged coaxial cable. Thus, expansion space is provided to be used by the thermally expanding coaxial cable during operation.

Furthermore, a thermal conductive member may be provided in the groove, the thermally conductive member interacting with the at least one coaxial cable and the base plate. The thermally conductive member improves the heat flow such that the heat dissipation of the coaxial cable is improved. The heat occurring in the coaxial cable is guided to its outer conductor which interacts with the thermally conductive member. Via the thermally conductive member, the heat is forwarded to the base plate in order to be dissipated by the base plate.

For instance, at least one of the groove for the at least one coaxial cable and the cut out for the resistive termination is milled in the base plate. This ensures a cost-efficient base plate with the respective structure wherein a good thermal contact between the base plate and the coaxial cable and/or the resistive termination is ensured. In addition, a compact design is ensured.

Another aspect provides that a thermally conductive pad for heat dissipation is provided, the pad being positioned on the at least one coaxial cable such that the at least one coaxial cable is at least partially covered by the pad. Thus, the heat occurring in the coaxial cable during operation of the dummy load can be dissipated via the thermally conductive pad in an effective manner. A good thermal contact of the at least one coaxial cable is ensured.

Moreover, at least one cover for heat dissipation may be provided, the at least one cover being connected to the base plate such that at least one of the resistive termination and the at least one coaxial cable being accommodated between the base plate and the at least one cover. The resistive termination as well as the coaxial cable are safely accommodated by the cover which also ensures that the heat is dissipated effectively, which might occur during operation of the dummy load. The cover also improves the shielding of the dummy load.

In some embodiments, the at least one cover presses the pad onto the at least one coaxial cable, the pad being positioned between the at least one coaxial cable and the at least one cover. Thus, the cover placed on the base plate presses the pad onto the coaxial cable in order to ensure a good thermal contact over a large area between the coaxial cable and the thermally conductive pad. This improves the heat dissipation of the dummy load.

Moreover, the at least one cover presses the at least one coaxial cable onto the base plate. Thus, the cover may directly press the coaxial cable into the groove provided by the base plate or indirectly via the thermally conductive pad which is sandwiched between the cover and the coaxial cable. However, the cover also ensures that a good thermal contact over a large area is provided between the coaxial cable and the base plate, in particular the walls defining the groove for the coaxial cable. Thus, the heat dissipation of the coaxial cable is further improved.

Another aspect provides that the at least one cover has cooling fins at a side facing away from the base plate. The cooling fins are used to dissipate the heat that is conducted from the coaxial cable and/or the resistive termination to the cover, in particular via the thermally conductive pad and/or the thermally conductive member.

According to another aspect, each side of the base plate has a groove for the coaxial cable, the coaxial cable being positioned in both grooves, two covers being provided that are assigned to both sides of the base plate such that both grooves are covered appropriately. Therefore, a very compact design of the dummy load is ensured as the base plate is sandwiched between two covers being assigned to opposite sides of the base plate. The coaxial cable is sandwiched between the base plate and the cover(s).

According to another embodiment, the base plate itself may have cooling fins at a side facing away from the cover. The cooling fins ensure that the heat dissipation of the dummy load is improved due to the fact that both sides of the dummy load comprise cooling fins wherein the cooling fins are provided by the cover and the base plate itself. This dummy load design may be used for a short coaxial cable that is only assigned to one side of the base plate.

In addition, a connection unit for a connecting cable may be provided, the connection unit being provided at the end of the at least one coaxial cable that is opposite to the end being connected to the resistive termination. Thus, a radio frequency connecting cable may be connected to the dummy load for inputting the electromagnetic signal.

Moreover, the base plate may have a rectangular shape which ensures that the use of the space is optimized.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

Figure 1:
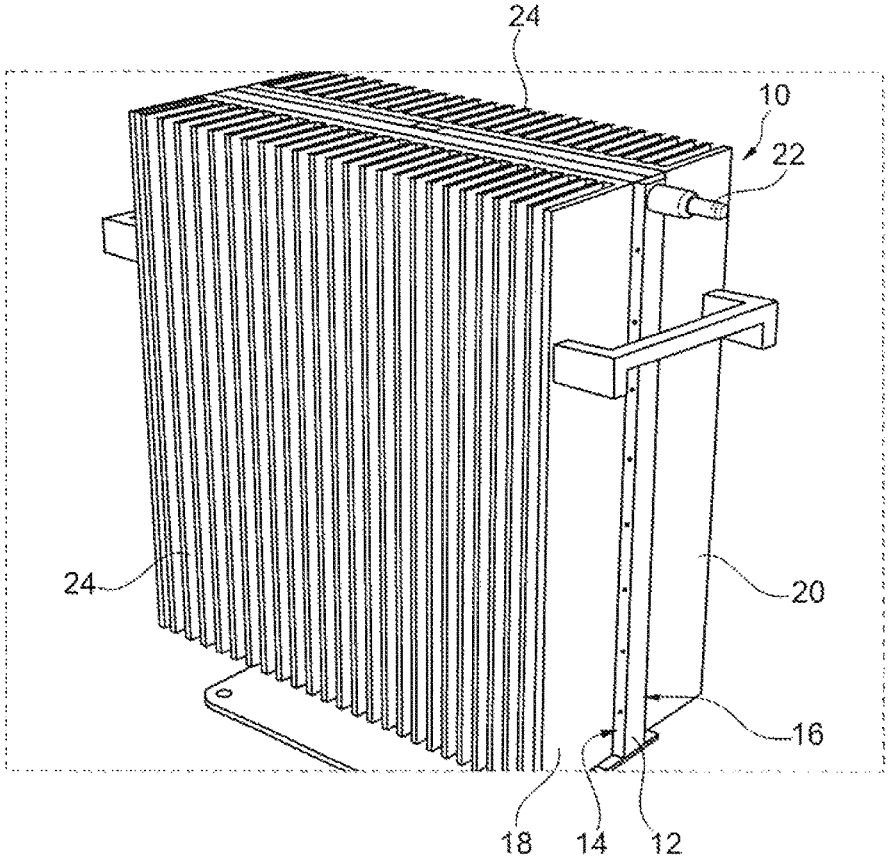
FIG. 1 shows a perspective view of a dummy load according to an embodiment of the present disclosure.

In FIG. 1, a dummy load 10 for high power and high bandwidth is shown. In the shown embodiment, the dummy load 10 comprises a base plate 12 made of aluminum with a first side 14 being opposite to a second side 16 as well as two covers 18, 20 that are assigned to both sides 14, 16 of the base plate 12. The dummy load 10 also has carrying grips that simplifies transport of the dummy load 10.

The dummy load 10 further has a connection unit 22 for a connecting cable (not shown), in particular a radio frequency connecting cable, via which radio frequency signals are inputted to the dummy load 10 for being dissipated appropriately. The connection unit 22 is established by a terminal as shown in FIG. 1.

Furthermore, it is shown that the covers 18, 20 each comprise cooling fins 24 at a side that faces away from the base plate 12, namely the first side 14 and the second side 16. The cooling fins 24 are used for dissipating the heat that occurs within the dummy load 10 as will be described later.

Figure 2:
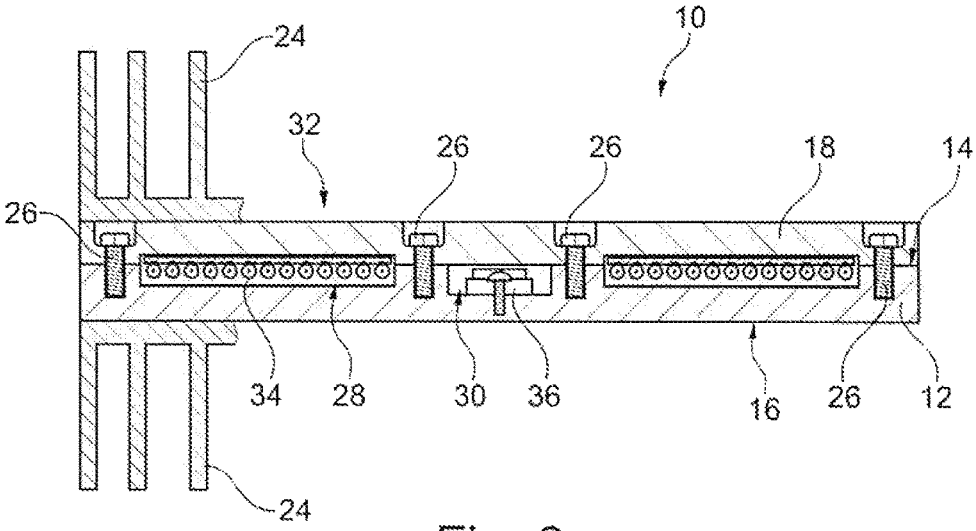
FIG. 2 shows a schematic cross section through a dummy load according to an embodiment of the present disclosure.

In FIG. 2, a cross sectional view of a dummy load 10 according to another embodiment is shown wherein the dummy load 10 comprises a base plate 12 as well as one cover 18 which is assigned to the first side 14 of the base plate 12. In contrast to the first embodiment shown in FIG. 1, the dummy load 10 of FIG. 2 comprises only a single cover 18 whereas the second side 16 of the base plate 12 is covered with cooling fins 24. Accordingly, the base plate 12 itself comprises cooling fins 24 that are arranged at the second side 16, namely the side that faces away from the single cover 18. The cooling fins 24 of the base plate 12 and the cover 18 are only partially shown for illustrative purposes.

As also shown in FIG. 2, the cover 18 is connected to the base plate 12 via connecting members 26, for instance screws, such that the cover 18 is pressed onto the first side 14 of the base plate 12.

On this first side 14 of the base plate 12, a groove 28 as well as a cut out 30 are established. The groove 28 as well as the cut out 30 may be milled within the first side 14 of the base plate 12 in order to provide space for a combined load 32 of the dummy load 10. In some embodiments, the combined load 32 comprises at least one coaxial cable 34 being positioned within the groove 28 as well as a resistive termination 36 that is located in the cut out 30. The at least one coaxial cable 34 comprises two conductors wherein the outer conductor can be established by a metal, for instance tinned outer fabric.

Figure 3:
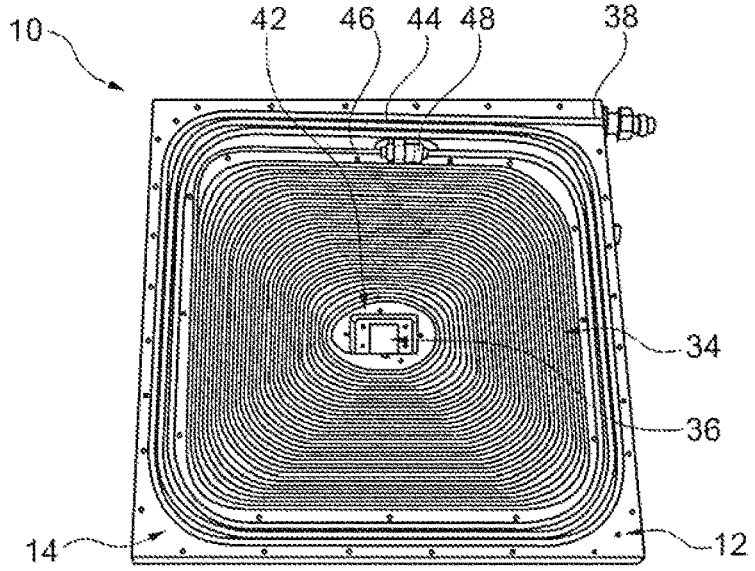
FIG. 3 shows a perspective view on a base plate used by a dummy load according to an embodiment of the present disclosure.

The arrangement of the load unit 32, in particular the coaxial cable 34 as well as the resistive termination 36, become more readily appreciated by FIG. 3 illustrating a perspective view on the base plate 12, in particular the first side 14 of the base plate 12, without the cover 18. As shown in FIG. 3, the coaxial cable 34 is arranged in a. helical manner on the first side 14 of the base plate 12 wherein a first end 38 of the coaxial cable 34 is connected with the connection unit 22 for receiving radio frequency signals inputted via the connecting cable. The opposite end 40 of the coaxial cable 34 is directly connected to the resistive termination 36 that is located in a middle area 42 of the base plate 12 for establishing the combined load 32.

The coaxial cable 34 that is arranged in a helical or rather spiral manner on the base plate 12, in particular within the groove 28, that is also provided within the first side 14 of the base plate 12 in a corresponding manner, namely in a spiral or rather helical manner.

The coaxial cable 34 has a cross section that varies over the length of the coaxial cable 34. In the shown embodiment, the at least one coaxial cable 34 has two different cross sections such that two coaxial cable sections 44, 46 are provided. Both coaxial cable sections 44, 46 are connected with each other via a transition member 48 that interconnects both coaxial cable sections 44, 46. Therefore, the coaxial cable 34 varies its cross section in stepwise manner.

Generally, the coaxial cable sections 44, 46 may be provided by a single coaxial cable with an integrated transition member 48.

The first coaxial cable section 44 with the high cross section is provided in the outer area of the base plate 12 such that it circumferences the second coaxial cable section 46 with the lower cross section. Accordingly, the bending radii of the whole coaxial cable 34 are as high as possible ensuring good transmission properties.

In general, this arrangement of the coaxial cable 34 ensures a compact dummy load 10 wherein the power loss provided by the coaxial cable 34 is distributed over its entire length. The first coaxial cable section 44 with the high cross section has a lower attenuation compared to the second coaxial cable section 46 such that the power dissipated by the coaxial cable 34 is dissipated over the total length of the coaxial cable 34 in a homogenous manner.

Figure 4:
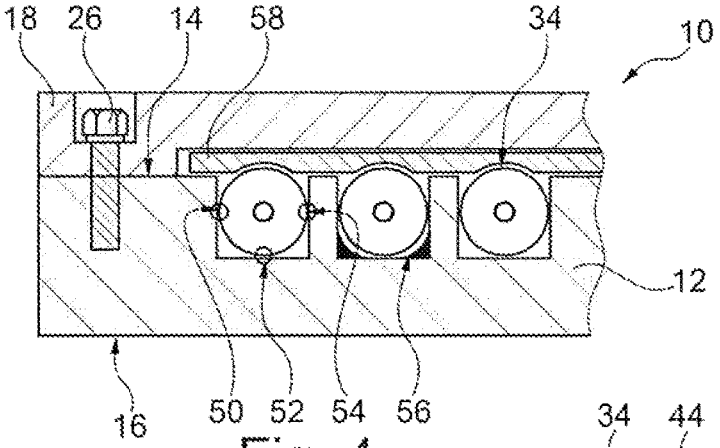
FIG. 4 schematically shows a detail of FIG. 2.

As already mentioned before, the coaxial cable 34 is located in a groove 28 that is milled within the first side 14 of the base plate 12. The coaxial cable 34 is pressed within this groove 28 such that the coaxial cable 34 has at least three contact points in a cross sectional view as shown in FIG. 4. The coaxial cable 34 contacts the walls of the groove 28 at its opposite sides as well as in its lower area such that three contact points 50 to 54 are provided which are highlighted in FIG. 4.

During operation of the dummy load 10, radio frequency power dissipated by the coaxial cable 34 may heat the coaxial cable 34 which in turn results in a thermal expansion of the coaxial cable 34. Thus, the thermal contact of the coaxial cable 34 via the contact points 50 to 54 is improved during operation, in particular at high powers, as the coaxial cable 34 thermally expends such that it is pressed against the sides of the groove 28. Therefore, the heat can be dissipated via the base plate 12 more efficiently.

For further improving the heat dissipation, a thermally conductive member 56 may be integrated in the groove 28 which contacts at least the areas between the contact points 50 to 54 in order to ensure that the heat occurring in these areas are also guided to the base plate 12 for heat dissipation.

Moreover, a thermally conductive pad 58 is provided that is located between the cover 18 and the coaxial cable 34 as shown in FIG. 4. The thermally conductive pad 58 is pressed onto the coaxial cable 34 when the cover 18 is fixed to the base plate 12 such that the outer area of the coaxial cable 34 with regard to the groove 28 is brought in contact with the thermally conductive pad 58 which in turn is pressed against the cover 18. The outer area of the coaxial cable 34 corresponds to the portion of the coaxial cable 34 that protrudes the groove 28. The thermally conductive pad 58 encircles this portion of the coaxial cable 34 appropriately such that the coaxial cable 34 is contacted on all sides ensuring a good thermal contact of the coaxial cable 34.

Accordingly, the coaxial cable 34 is thermally connected to the base plate 12 (via the thermally conductive member 56) and to the cover 18 (via the thermally conductive pad 58).

Figure 5:
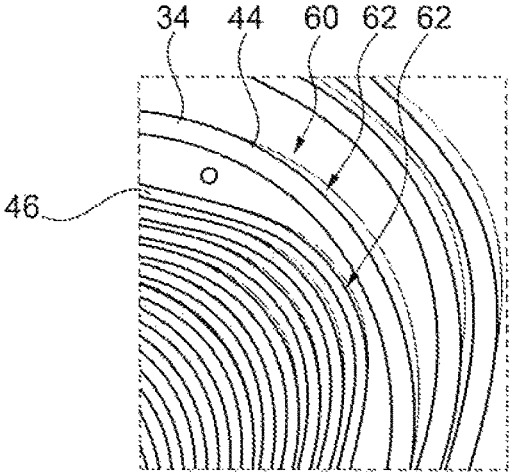
FIG. 5 schematically shows a detail of FIG. 3.

In FIG. 5, it is shown that the groove 28 milled in the base plate 12 comprises curvatures 60 for the bending sections of the coaxial cable 34 being arranged in a helical manner in the groove 28. These curvatures 60 are widened in order to provide expansion space 62 in the curvatures 60 for the coaxial cable 34. Thus, the coaxial cable 34 may thermally expand in the area of the curvatures 60, namely in its bending sections. The expansion spaces 62 provide enough space for the thermal expansion of the coaxial cable 34.

The embodiment shown in FIG. 1 which comprises two covers 18, 20 may have a groove 28 which is established on both sides 14, 16 of the base plate 12 such that the dummy load 10 may comprise a coaxial cable 34 being arranged on both sides 14, 16 of the base plate 12. Thus, a coaxial cable 34 can be used having a length exceeding the area of the base plate 12 on one side.

Accordingly, a very compact dummy load 10 may be provided wherein the coaxial cable 34 is helically arranged on both sides 14, 16 of the base plate 12 in a substantially similar manner as shown in FIG. 3.

Generally, the whole dummy load 10 is established in a sandwich manner as the opposite outer sides of the dummy load 10 comprise the cooling fins 24 which may be arranged on two covers 18, 20 or on one cover 18 and the base plate 12. However, good heat dissipation properties are ensured. The bodies of the cover(s) 18, 20 and the base plate 12 may also have channels for conducting water or any other suitable fluid used for cooling purposes.

In general, the combined load unit 32 having the resistive termination 36 as well as the coaxial cable 34 ensures that the resistive termination 36 acts as a resistive load for a dissipating radio frequency power at low frequencies whereas the coaxial cable 34 acts as a cable load for a dissipating radio frequency power at high frequencies. Accordingly, the combined load unit 32 is configured to dissipate radio frequency power over a broad bandwidth.

Figure 6:
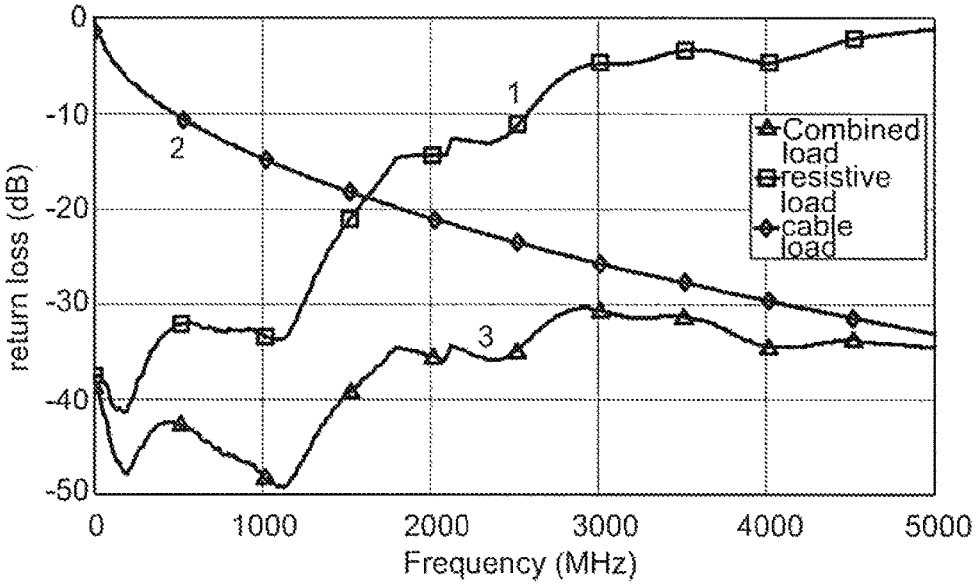
FIG. 6 shows a diagram illustrating the return loss of different dummy loads.

This is also illustrated in FIG. 6 showing the return loss of a cable load, a resistive load and a combined load unit 32 as used by the dummy load 10 according to the embodiments of the present disclosure.

Moreover, the arrangement of the combined load unit 32 according to the present disclosure ensures that the cable attenuation of the coaxial cable 34 is used in an optimized manner as the power reaching the resistive termination 36 for signals with high frequencies is reduced due to the cable attenuation of the coaxial cable 34, which increases with higher frequency.

Figure 7:
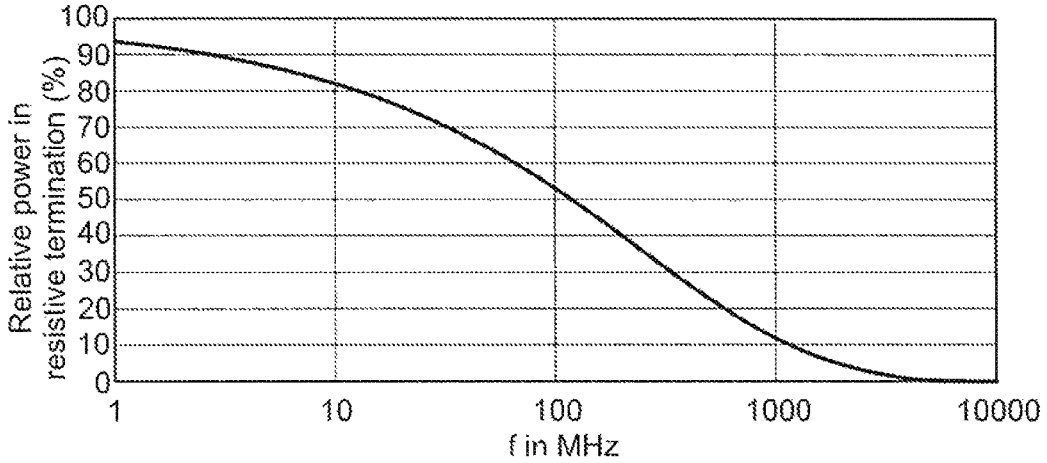
FIG. 7 shows a diagram illustrating the relative power over the frequency reaching the resistive termination of the dummy load according to an embodiment of the present disclosure.

This is also shown in FIG. 7. The relative power reaching the resistive termination 36 is reduced significantly for higher frequencies due to the cable attenuation increasing with frequency.

Therefore, a dummy load 10 is provided that can be used for high power and high bandwidth applications.

Furthermore, the dummy load 10 can be used in Electromagnetic Compatible Chambers (EMC chambers) as substantially the whole power is absorbed in the coaxial cable 34 for signals with high frequency wherein the coaxial cable 34 is hermetically sealed. For lower frequencies, the power reaches the resistive termination 36 wherein a higher shielding attenuation is provided due to the higher wavelengths at lower frequencies. Thus, the irradiation of the dummy load 10 is small such that the dummy load 10 can be used for EMC applications.

Generally, the dummy load 10 compensates the matching properties of the resistive termination 36 which gets worse with increasing frequency by the frequency dependent cable attenuation of the coaxial cable 34.

For low frequencies of the radio frequency signals, the power of the radio frequency signals inputted to the dummy load 10 is substantially completely forwarded to the resistive termination 36 due to the small cable attenuation of the coaxial cable 34. Thus, the input matching of the dummy load 10 is mainly specified by the resistive termination 36.

For high frequencies, the cable attenuation of the coaxial cable 34 increases such that the power reaching the resistive termination 36 is attenuated effectively. Thus, the matching of the dummy load 10 is mainly specified by the cable attenuation of the coaxial cable 34.

Various principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the claimed subject matter.

The embodiments of the invention in which an exclusive property or privilege is claimed are defined as follows:

1. A dummy load for high power and high bandwidth, said dummy load comprising:

a base plate, a groove being provided in said base plate, a resistive termination acting as a resistive load for dissipating radio frequency power at low frequencies, at least one coaxial cable acting as a cable load for dissipating radio frequency power at high frequencies, said at least one coaxial cable having a cross section that varies over the length of said coaxial cable, wherein said at least one coaxial cable is connected to said resistive termination, said at least one coaxial cable being placed in said groove, at least one of said resistive termination or said at least one coaxial cable being positioned on said base plate, wherein said groove has curvatures, said groove being widened in the curvatures such that said groove has an expansion space for said at least one coaxial cable in the curvatures, said expansion space being used by the thermally expanding coaxial cable during operation.

2. A dummy load for high power and high bandwidth, said dummy load comprising:

a base plate, a resistive termination acting as a resistive load for dissipating radio frequency power at low frequencies, at least one coaxial cable acting as a cable load for dissipating radio frequency power at high frequencies, said at least one coaxial cable being connected to said resistive termination, said resistive termination and said at least one coaxial cable being positioned on said base plate, said at least one coaxial cable having a cross section that varies over the length of said coaxial cable, a thermally conductive pad for heat dissipation, said pad being positioned on said at least one coaxial cable such that said at least one coaxial cable is at least partially covered by said pad, and at least one cover being connected to said base plate such that said resistive termination and said at least one coaxial cable are accommodated between said at least one cover and said base plate, said at least one cover pressing said thermally conductive pad onto said at least one coaxial cable, said thermally conductive pad being positioned between said at least one coaxial cable and said at least one cover.

3. The dummy load according to claim 2, wherein said cross section varies in a stepwise manner.

4. The dummy load according to claim 2, wherein said at least one coaxial cable is arranged in a helical manner, said cross section decreasing inwardly over the length of said at least one coaxial cable.

5. The dummy load according to claim 2, wherein said at least one cover presses said at least one coaxial cable onto said base plate.

6. The dummy load according to claim 2, wherein said at least one cover has cooling fins at a side facing away from said base plate.

7. The dummy load according to claim 2, wherein each side of said base plate has a groove for said at least one coaxial cable, said coaxial cable being positioned in both grooves, two covers being provided that are assigned to both sides of said base plate such that both grooves are covered.

8. The dummy load according to claim 2, wherein a connection unit for a connecting cable is provided, said connection unit being provided at the end of said coaxial cable that is opposite to the end being connected to said resistive termination.

9. The dummy load according to claim 2, wherein said base plate has a rectangular shape.

10. The dummy load according to claim 2, wherein at least one of a cut out for said resistive termination or a groove for said at least one coaxial cable is provided in said base plate.

11. The dummy load according to claim 10, wherein said cut out for said resistive termination is located in a middle area of said base plate.

12. The dummy load according to claim 10 wherein said groove for said at least one coaxial cable is provided on opposite sides of said base plate such that said at least one coaxial cable is arranged on both sides of said base plate.

13. The dummy load according to claim 10, wherein said groove for said at least one coaxial cable has curvatures, said groove being widened in the curvatures such that said groove has an expansion space for said at least one coaxial cable in the curvatures.

14. The dummy load according to claim 10, wherein a thermal conductive member is provided in said groove, said thermal conductive member interacting with said at least one coaxial cable and said base plate.

15. The dummy load according to claim 10, wherein at least one of said groove for said at least one coaxial cable or said cut out for said resistive termination is milled in said base plate.

16. The dummy load according to claim 10, wherein said groove for said at least one coaxial cable is helically arranged on at least one side of said base plate.

17. The dummy load according to claim 16, wherein said groove runs around said resistive termination at least once.

18. A dummy load for high power and high bandwidth, said dummy load comprising:

a base plate, a resistive termination acting as a resistive load for dissipating radio frequency power at low frequencies, at least one coaxial cable acting as a cable load for dissipating radio frequency power at high frequencies, said at least one coaxial cable being connected to said resistive termination, said at least one coaxial cable being arranged in a helical manner within a groove formed in said base plate, a thermally conductive pad for heat dissipation, said pad being positioned on said at least one coaxial cable such that said at least one coaxial cable is at least partially covered by said pad, and at least one cover being connected to said base plate such that said resistive termination and said at least one coaxial cable being accommodated between said at least one cover and said base plate, said at least one cover pressing said thermally conductive pad onto said at least one coaxial cable, said thermally conductive pad being positioned between said at least one coaxial cable and said at least one cover.

* * * * *